United States Patent [19]

Roeder

[11] 4,214,854

[45] Jul. 29, 1980

[54] HYDRAULICALLY ACTUATED PUMP ASSEMBLY HAVING MECHANICALLY ACTUATED VALVE MEANS

[76] Inventor: George K. Roeder, P.O. Box 4335, Odessa, Tex. 79761

[21] Appl. No.: 941,222

[22] Filed: Sep. 11, 1978

Related U.S. Application Data

[62] Division of Ser. No. 689,576, May 24, 1976, Pat. No. 4,118,154.

[51] Int. Cl.[2] ..... F04B 17/00; F04B 35/00; F01L 15/12; F01B 7/18

[52] U.S. Cl. ..... 417/402; 417/403

[58] Field of Search ..... 417/402, 403, 404; 91/224, 313, 321

[56] References Cited

U.S. PATENT DOCUMENTS

| | | | |
|---|---|---|---|
| Re. 24,812 | 4/1960 | Deitrickson | 91/321 X |
| 2,682,257 | 6/1954 | Deitrickson | 91/321 X |
| 2,746,431 | 5/1956 | Tebbetts | 91/321 X |
| 2,933,071 | 4/1960 | Sargent et al. | 91/321 X |
| 2,943,576 | 7/1960 | English | 417/403 X |
| 2,983,227 | 5/1961 | English | 91/224 X |
| 3,050,038 | 8/1962 | Bloudoff | 91/224 |
| 3,502,028 | 3/1970 | Cooper | 417/404 |

*Primary Examiner*—Leonard E. Smith
*Attorney, Agent, or Firm*—Marcus L. Bates

[57] ABSTRACT

A downhole, hydraulically actuated pump assembly, having an engine reciprocatingly connected to a production pump. Power fluid is conducted downhole to the engine of the pump assembly, while production fluid and spent power fluid is conducted uphole to the surface of the ground.

The pump assembly includes a housing within which spaced, axially aligned, cylindrical chambers reciprocatingly receive spaced engine and pump pistons which are connected together in a manner to enable the engine to reciprocate the production pump.

A mechanically actuated valve assembly is contained within the engine piston and is arranged respective to various different flow passageways so that flow of power fluid through the engine forces the engine piston to reciprocate.

The valve assembly includes a control rod and a valve element concentrically arranged respective to one another and to the engine piston. The valve element is reciprocated respective to the engine piston in response to reciprocation of the control rod. Abutment means formed on the engine cylinder shifts the control rod each stroke of the piston, thereby causing the valve element to shift respective to the piston, whereupon various different flow passageways are aligned with one another to cause power fluid to be effected upon the engine in such a manner that the engine piston reciprocates to thereby force the pump piston to be reciprocated within its cylinder.

11 Claims, 9 Drawing Figures

HYDRAULICALLY ACTUATED PUMP ASSEMBLY HAVING MECHANICALLY ACTUATED VALVE MEANS

REFERENCE TO RELATED APPLICATIONS

The instant application is a DIVISION of patent application Ser. No. 689,576 filed May 24, 1976, entitled "HYDRAULICALLY ACTUATED PUMP ASSEMBLY HAVING MECHANICALLY ACTUATED VALVE MEANS", now U.S. Pat. No. 4,118,154, issued Oct. 3, 1978.

BACKGROUND OF THE INVENTION

In producing deep wellbores, it is advantageous to employ a downhole, hydraulically actuated pump assembly which is simple in design, rugged in construction, and which includes a minimum number of parts, thereby achieving the advantage of a long operating time interval between pump overhauls. A pump with these desirable attributes would be expected to withstand the abuse which usually leads to early malfunction or breakage of the various component parts thereof.

In my previous U.S. Pat. No. 3,517,741, there is disclosed a pilot valve arranged eccentrically respective to the engine control valve. The present invention provides improvements in the engine and valve assembly of this and other prior art hydraulically actuated, downhole pumping systems.

In my previous U.S. Pat. No. 3,703,926, there is disclosed a downhole, hydraulically actuated pump which includes an engine and pump piston arranged with diametrically opposed faces which operate within a common fluid chamber. The present invention retains some of the advantages of this previously issued patent and additionally offers novel constructional features which overcome rod breakage in this and other prior art downhole pumps. Reference is also made to my previously issued U.S. Pat. Nos. 3,453,936; 3,625,288; and 3,865,516 for further background of this invention.

In the above referred to patents, as well as many other prior art downhole, hyraulically actuated pump systems, the length of the engine, control valve, and production pump must often attain a substantial value which contributes to rod breakage. Moreover, in many of these prior art pump assemblies, the rod which interconnects the engine and production pump pistons together is placed under tremendous tension, and this also leads to rod breakage. Accordingly, it would be desirable to provide a downhole pump assembly having all of the above attributes, while at the same time, overcoming many of the defects pointed out above, as well as other defects which may be found in many of the prior art pump assemblies.

SUMMARY OF THE INVENTION

Improvements in a downhole, hydraulically actuated pump assembly for producing wellbores. The pump assembly includes an engine, a production pump, and means by which a supply of hydraulic power fluid is connected to the engine. Flow passageway means provide a supply of production fluid to the production pump inlet, while suitable outlet means are provided by which spent power fluid and produced formation fluid can be flowed away from the downhole pump and to the surface of the ground.

The pump assembly of the present invention includes a main housing within which there is formed an engine cylinder and a pump cylinder, with the two cylinders being spaced from and axially aligned with respect to one another. An engine piston reciprocates within the engine cylinder, while a pump piston reciprocates within the pump cylinder, and a connecting rod ties the pump and engine pistons to one another.

In one embodiment of the invention, a marginal length of the connecting rod sealingly reciprocates within a seal means which isolates the pump and engine cylinders from one another. In a second embodiment of the invention, the pump and engine pistons mutually share a common cylinder chamber.

In both embodiments of the present invention, the control valve is contained within the traveling engine piston and is mechanically actuated to control the flow of power fluid and spent power fluid to and from the engine in a new and improved manner which constitutes part of the present invention.

The control rod of the valve assembly is concentrically arranged respective to various other components of the valve assembly and is axially aligned respective to the axial centerline of the engine and pump pistons.

Accordingly, a primary object of the present invention is the provision of improvements in the construction and operation of a downhole, hydraulically actuated pump assembly.

Another object of the invention is to provide improvements in a downhole, hydraulically actuated pump assembly by which fluid flows to and from the pump in a new and unusual manner.

A further object of this invention is to disclose and provide a downhole pump assembly of the free type which includes improvements in the arrangement of the production pump, engine, and control valve.

A still further object of this invention is to provide improvements in the design and operation of a fixed-type, downhole production pump wherein the engine, production pump, and control valve are arranged respective to one another in a new and unobvious manner.

Another and still further object of this invention is to provide a downhole, hydraulically actuated production pump having a minimum number of moving parts so that the resultant structure provides a more dependable and longer lasting pump assembly.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
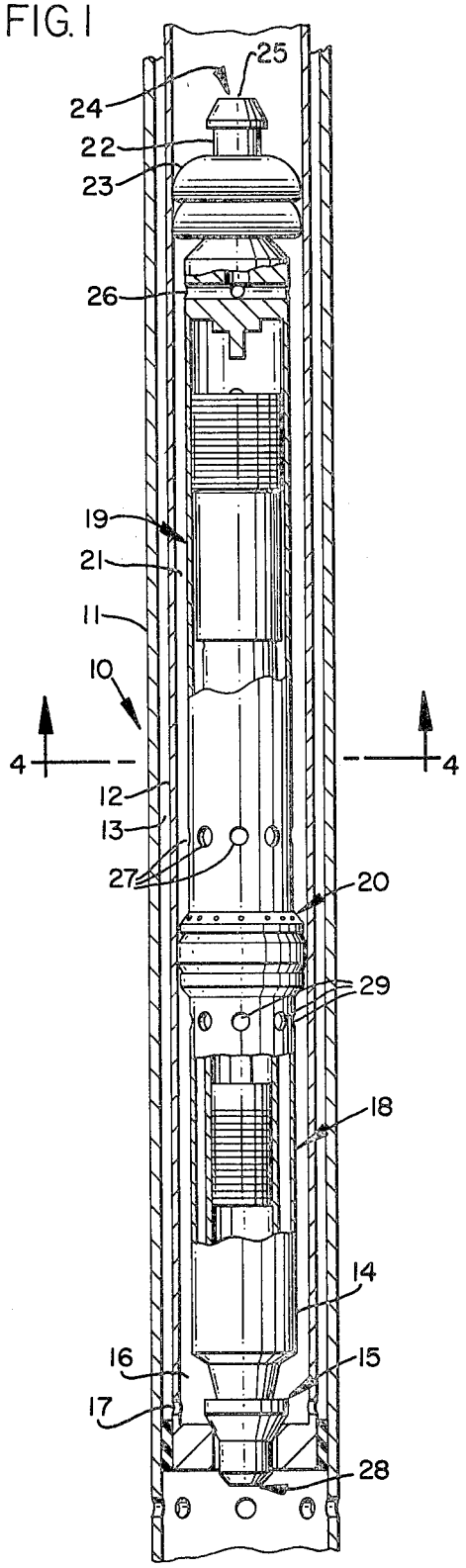
FIG. 1 is a longitudinal, part cross-sectional view of a hydraulically actuated, downhole pump assembly disposed within the lower portion of a borehole and fabricated in accordance with the present invention.

In FIGS. 1-4 of the drawings, there is disclosed a free-type, downhole, hydraulically actuated pump assembly 10 made in accordance with the present invention. The pump assembly is illustrated as being positioned downhole within a cased borehole, and the usual casing 11 and tubing 12 which form annulus 13 therebetween is included in the drawings. The pump assembly of the present invention is provided with a pump inlet end 14 which is removably engaged in seated relationship respective to a seating shoe 15, the details of which are more fully set forth in my above mentioned previous patents. Annulus 16 is formed between the lower production end of the pump and the tubing string. Radial ports 17 freely interconnect annulus 13 and 16.

The production pump section comprises the lower marginal end 18 of the assembly, while the engine section 19 comprises the upper marginal end of the assembly. Seal assembly 20 is interposed between the engine and pump ends and is comprised of a circumferentially extending seal which engages the interior peripheral wall surface of the tubing string in a manner to cause annulus 21 to be separated from annulus 16.

The upper extremity of the pump apparatus includes a conventional packer nose assembly having a power fluid inlet 22 and a plurality of packer nose seals 23. The packers preclude power fluid at 24 from flowing across the seals and into the annulus 21. Power fluid must therefore flow into inlet 25 and into the annulus 21 by means of the radial ports 26. Power fluid enters the pump assembly at radial inlet ports 27, production fluid enters the pump end by means of production inlet 28, while spent power fluid and production fluid exit the pump assembly at outlet ports 29, where the fluid is free to flow from annulus 16 into annulus 13 and to the surface of the ground.

Figure 2:
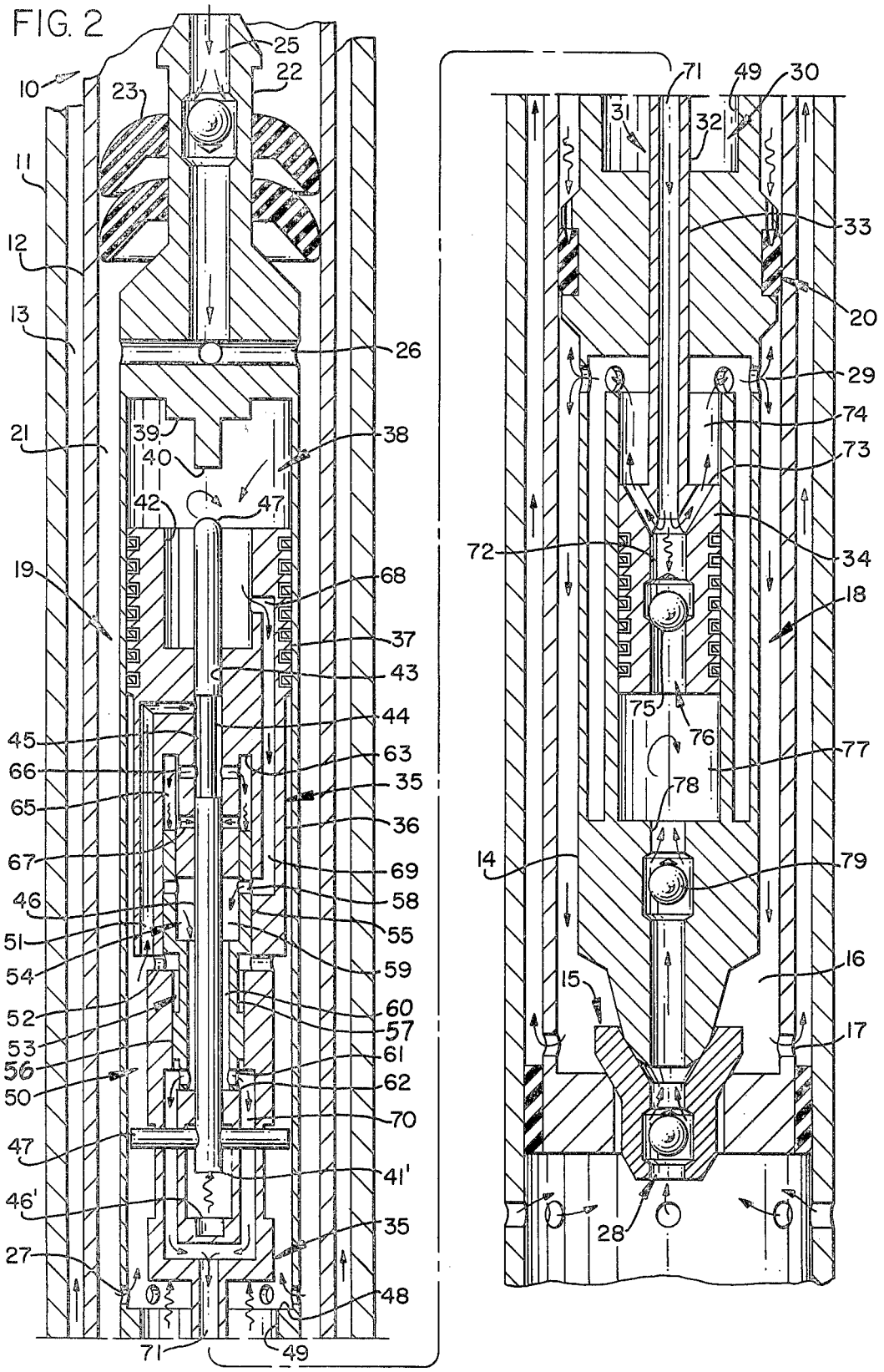
FIG. 2 is an enlarged, longitudinal, part cross-sectional detailed view of the pump assembly seen disclosed in FIG. 1.
Figure 3:
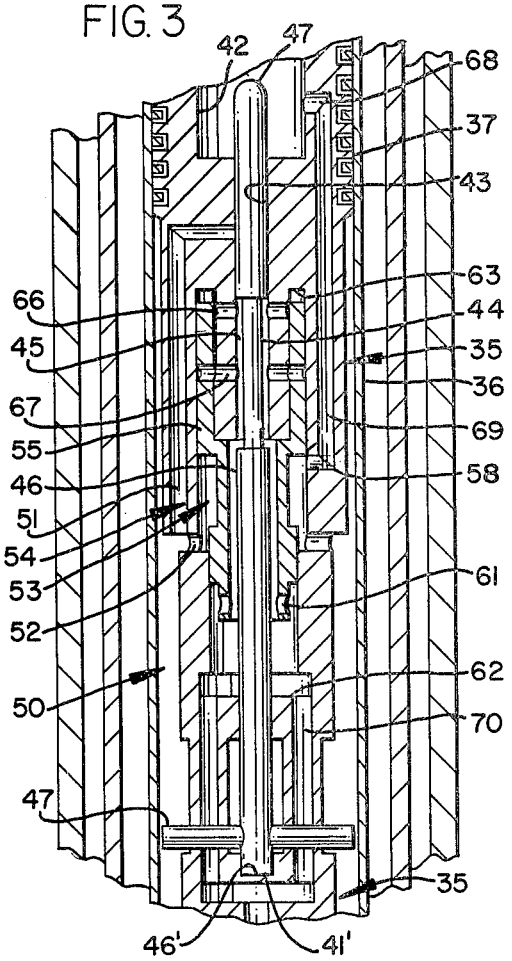
FIG. 3 is a fragmentary, part cross-sectional view of part of the apparatus disclosed in the foregoing figures; with the parts thereof being arranged in an alternate configuration respective to one another.
Figure 4:
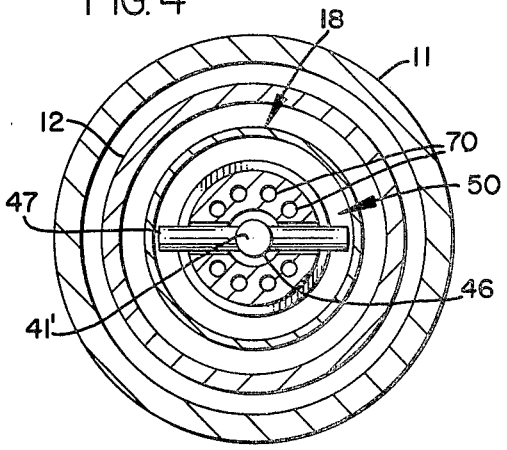
FIG. 4 is a cross-sectional view taken along line 4—4 of FIG. 1.

As best seen illustrated in FIG. 2 in conjunction with FIGS. 1, 3, and 4, the main housing of the pump forms an engine cavity which extends down to a lower end broadly indicated by the numeral 30. Connecting rod 31 is concentrically arranged along the central longitudinal axis of the pump assembly and includes a constant diameter portion 32 having a marginal length thereof sealingly received in a reciprocating manner at 33, within the area of the pump where the before mentioned seal assembly is located. Hence the seal assembly separates the pump end from the engine end of the pump assembly. A pump piston 34 is affixed to one end of the connecting rod, while the engine piston assembly 35 is affixed to the opposed rod end. The engine piston includes a marginal central portion 36 which enlarges at 37 into sealed engagement respective to the illustrated, cylindrical, piston receiving chamber 38. Hence the piston chamber extends from 38 down to 30.

The upper extremity of the chamber reduces in diameter at 39 and again at 40, so that the downwardly directed terminal end 40 engages the upper terminal end 47 of a pilot rod, while the larger diameter portion 39 is received within a cavity 42 formed within the upper end of the piston.

The pilot or control rod is reciprocatingly received through an axial bore 43 of the piston. The pilot rod is reduced in diameter at 44 to form a travling annulus 45, sometimes called a "flat". The pilot rod continues through the piston at 46 and terminates in a lateral actuator 47, which is removably received by the lower end of the control rod.

The cylinder is provided with a circumferentially extending abutment 48 formed by a reduced i.d. cylinder wall at 49, with the lower marginal end of the piston being received within lower marginal cylinder portion 49.

Annulus 50 is formed between the lower end of the piston and cylinder wall, and flow communicates a longitudinal piston passageway 51 and a radial inlet port 52 with the power fluid inlet ports 27. Passageway 51 continues up through the piston and into communication with the axial piston bore 43. Radial port 52 leads into proximity of a traveling annulus 53 of a traveling valve element 54. The valve element includes a large o.d. upper marginal end 55 and a small o.d. portion 56 separated from one another by the reduced diameter portion 57. Ports 58 communicate annular areas 59 and 60 with radial ports 61 which are formed in the lower marginal end portion of the valve element.

The piston includes a lower abutment 62 which abuttingly receives the lower end portion of the valve element. An upper abutment 63 abuttingly engages the uppermost end portion of the valve element as the element reciprocates within an annular chamber 65. Radial ports 66 communicate annulus 45 with annulus 65. Radial ports 67 communicate annulus 65 with the axial passageway 43. Port 68 communicates upper cylinder chamber 38 with a longitudinal piston passageway 69, which in turn communicates with annulus 59 by means of ports 58.

Radial, spaced-apart, longitudinal flow passageways 70 extend from the lower annulus 53 formed between the control rod and the piston bore and extend into communication with the interior 71 of the hollow connecting rod.

The pump piston is provided with an axial bore 72 which is placed in communication with the hollow connecting rod, and further includes radially spaced-apart passageways 73 leading into the working chamber 74 of the pump barrel. Ball check valve 75 is captured within the interior of the piston so that one-way flow can occur from the piston inlet 76, across the valve, and up through passageway 72, through ports 73, into the piston working chamber of the barrel. Hence the working barrel is divided into an upper chamber 74 and lower chamber 77 by means of the pump piston 34.

The working barrel is connected to a lower inlet passageway 78 within which a ball check valve 79 is captured to provide a standing valve assembly. The seating shoe 15 preferably contains a ball check valve so that flow can occur only through inlet 28, into the pump stinger, across the valve 79, and into the chamber 77.

In operation, the free pump of the first embodiment of this invention is pumped downhole, where it ultimately becomes seated in the illustrated position of FIGS. 1 and 2. Power fluid is now available to the upstream side of the valve assembly.

Power fluid flows down the interior of tubing 12 and enters the pump inlet at 25, continues through radial ports 26, into annulus 21, where the power fluid enters chamber 50 of the engine by means of radial inlet ports 27.

Power fluid flows up annulus 50 and into passageway 51, into the annulus 45, through port 66, annulus 65, where the power fluid exerts a force on the traveling valve element 55, and consequently forces the valve element into the illustrated lowermost position of FIG. 2.

At the same time, chamber 38 of the engine is connected to chamber 74 of the production pump, thereby enabling spent power fluid to be exhausted from chamber 38. The spent power fluid flows through port 68, down through passageway 69, through port 58 of the valve element, into annulus 59, annulus 60, through port 61, into the radial 14 spaced, longitudinal passageways 70, into the hollow connecting rod at 71, into passageway 72 of the production piston, through radially spaced-apart inclined ports 73, and into the upper production piston chamber 74. Accordingly, both of the pistons are in the act of upstroking, because power fluid is exerted within chamber 30, while spent power fluid is being exhausted from chamber 38.

The spent power fluid admixes with production fluid at 74 and is forced through the radial production ports 29, into annulus 16, through ports 17, and up through the casing annulus 13 to the surface of the ground.

As the engine piston continues to upstroke, abutment 40 contacts power rod end 47 towards the end of the upstroke, thereby forcing the pilot rod to move downwardly to its lowermost limit of travel, whereupon valve element 55 is shifted into its uppermost extreme limit of travel according to the following sequence of events:

As the pilot rod shifts to its lowermost position, annulus 45 interconnects passageway 67 and annulus 59, while at the same time obstructing flow of fluid through passageway 51, thereby exhausting fluid from annulus 65, with the resultant force of the power fluid at annulus 53 causing the valve element to be driven in an upward direction.

As seen in FIG. 3, as the valve element shifts towards its uppermost limit of travel, annulus 53 interconnects ports 58 and 52, thereby enabling power fluid to flow from 50, into port 52 and to annulus 53, into passageway 69, through port 68, into the upper piston chamber 38, thereby driving the piston in a downward direction.

Accordingly, the effective areas of opposed sides of the piston must be of a value whereby the force of the power fluid exerted within chamber 30 will force the piston of the engine to move upwardly when chamber 38 is connected to exhaust into the production chamber of the pump; and when power fluid is exerted within chamber 38, the piston is forced to move against the force of the power fluid contained within chamber 30, with the above described downward movement.

As the piston strokes in a downward direction, pilot valve actuator 47 abuttingly engages shoulder 48 to thereby shift the pilot rod into its illustrated uppermost position seen in FIG. 2. It will be noted that the marginal end 41' of the control rod is received within small cavity 46' of the lower piston end to releasably hold the rod in its lowermost position with a small suction force.

A second embodiment of the invention is disclosed in FIGS. 5–9 wherein there is disclosed a fixed-type pump 110 having the lowermost end 14' thereof sealingly seated respective to a seating shoe 15', so that production fluid enters the illustrated perforated casing and flows into the pump inlet in the manner broadly illustrated by the arrow at numeral 28'.

Figure 5:
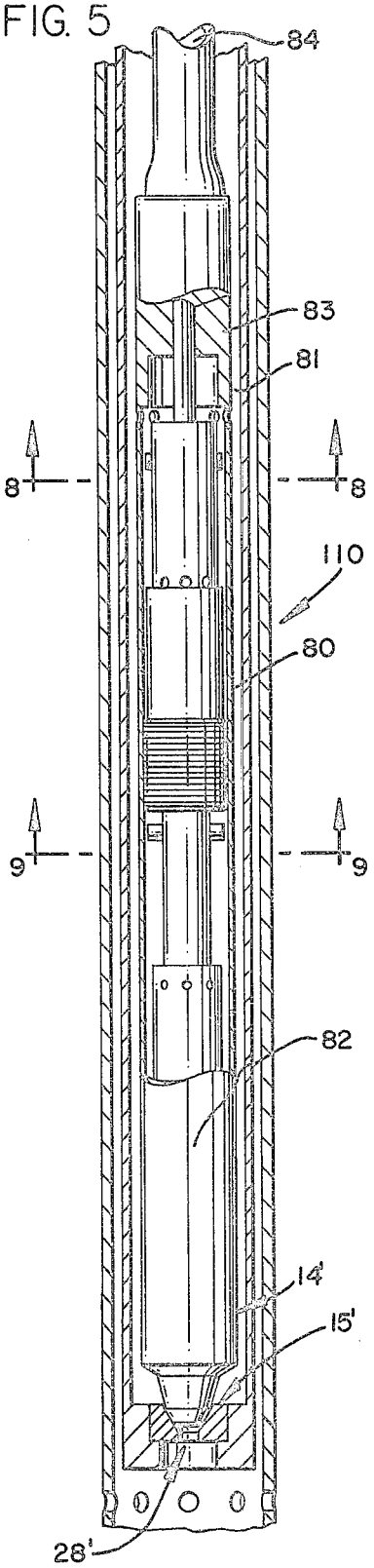
FIG. 5 is a longitudinal, part cross-sectional view of another embodiment of the present invention disclosing a fixed, hydraulically actuated pump assembly disposed downhole in a borehole.
Figure 6:
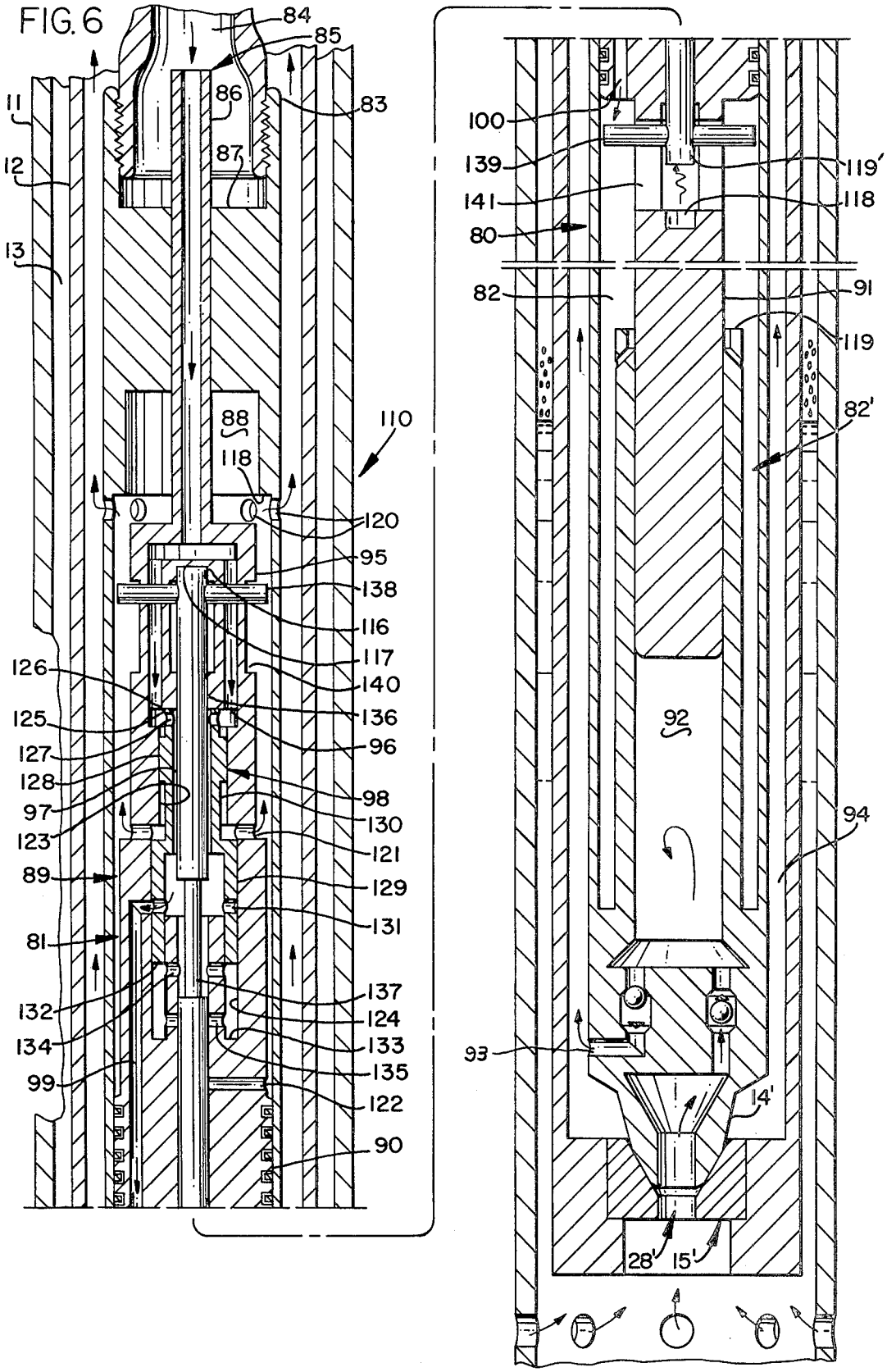
FIG. 6 is an enlarged, detailed, part cross-sectional view of the embodiment of the invention disclosed in FIG. 5.
Figure 7:
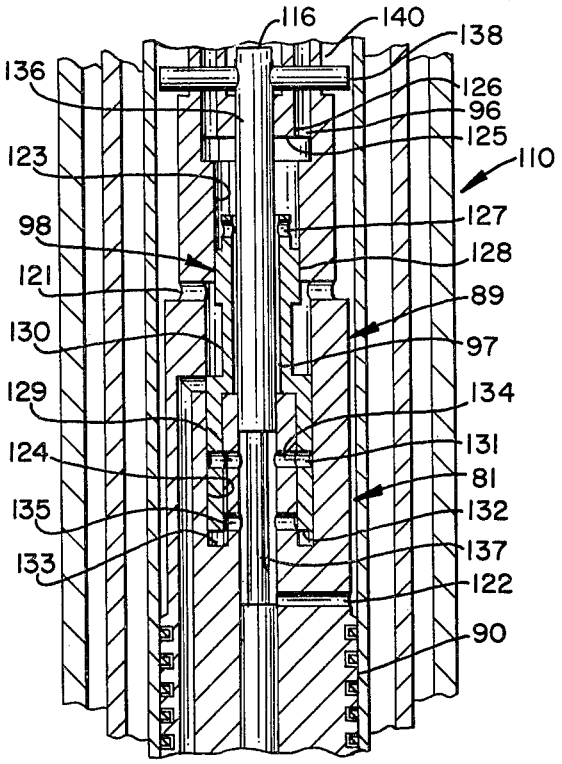
FIG. 7 is a fragmentary, detailed view of part of the apparatus disclosed in FIG. 6, with some parts thereof being arranged in an alternate configuration.
Figure 8:
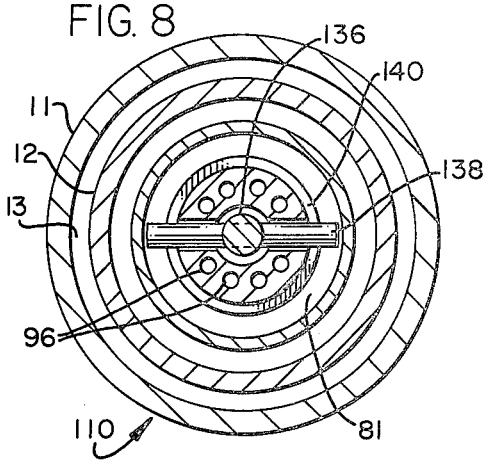
FIG. 8 and 9, respectively, are cross-sectional views taken along lines 8—8 and 9—9, respectively, of FIG. 5.
Figure 9:
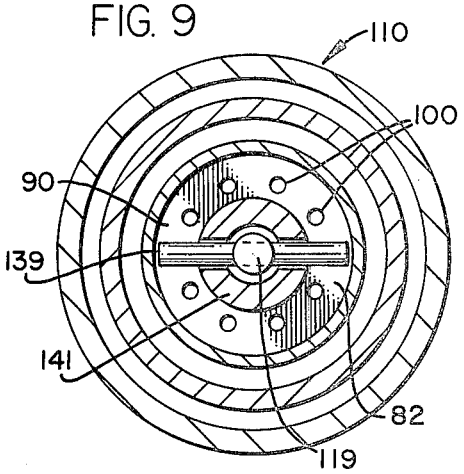

The pump assembly of FIG. 5 includes a main housing 80, and the upper end 81 thereof is an engine end while the lower marginal end 82 thereof is a production end. As best seen in FIG. 6, the uppermost end portion 83 of the pump assembly is connected to a power fluid tubing 84 which enables power fluid to enter inlet 85 of an axially disposed hollow rod 86. The hollow rod is sealingly and reciprocatingly received within an upper seal assembly 87, thereby isolating an upper engine chamber 88 from the power fluid supply at 84.

Engine piston assembly 89 is axially aligned and connected to the hollow rod 86. The piston assembly outwardly increases in diameter, where it sealingly engages a marginal inside peripheral wall surface of the housing at 90. Production piston 91 is rigidly affixed to a lower end portion of the piston 90 and reciprocates within a working barrel, which provides the illustrated production pump chamber 92.

Produced fluid outlet 93 is connected to chamber 92 by the illustrated check valve, while inlet 28' is connected to the working chamber 92 by the similarly illustrated check valve.

Produced fluid annulus 94 is formed between the pump housing and the production tubing 12, thereby forming a fluid flow path to the surface of the earth.

The upper marginal end portion 95 of the engine piston forms a valve housing within which radially arranged, longitudinally disposed passageways 96 form a power fluid flow passageway to the illustrated annular area 97. An annular valve element 98 reciprocates within the last named annular passageway and forms a means by which fluid can flow from the before mentioned passageways 96 into the longitudinal piston passageways 99 and through the outlet 100, where power fluid is available within the before mentioned working chamber 82. It should be noted that the engine and production pistons mutually share the common chamber 82.

Port 120 communicates the upper cylinder chamber 88 with the annulus 94 so that fluid within annulus 94 is free to flow into and out of chamber 88 as the piston reciprocates therewithin. Radial ports 121 and 122 are formed within a sidewall of the upper piston at a location spaced above the piston rings for a purpose which will be better appreciated later on.

Annular wall 123 increases in diameter at 124 for sealingly engaging spaced, outer wall surfaces of the traveling valve element therewithin. The uppermost end 125 of the traveling valve element abuttingly engages the lowermost end 126 of the uppermost end of bore 123. Ports 127 allow fluid to flow from the radially spaced, longitudinal passageways 96 into annulus 97. The traveling valve element enlarges at 128 and sealingly engages bore 123. The traveling valve element again enlarges at 129 where it sealingly engages bore 124. An undercut area 130 formed between enlargements 128 and 129 forms the illustrated traveling annulus, which is jointly formed between the traveling valve element and the coacting central axial bore of the upper marginal end of the piston.

Ports 131 are radially spaced above a lower end portion 132 of the valve element and connect annulus 97 with longitudinal passageway 99. Annular, upwardly disposed abutment 133 is formed by the lowermost end portion of the counterbore 124 and abuttingly receives the lower end of the valve element. Spaced radial ports 134 and 135 are especially provided in cooperation with the traveling valve element and pilot rod 136 to enhance the action of the valve section of the pump assembly, and to exhaust fluid from 124 into 122. The pilot rod is provided with the illustrated flat or undercut area 137, which actuates the valve element into its alternate positions, as will be more specifically pointed out later on in this disclosure.

Upper and lower pilot rod actuators 138 and 139, respectively, are removably affixed to the marginal, opposed, terminal ends of the pilot rod and are slidably received within the illustrated slots 140 and 141, respectively, to thereby reciprocatingly capture the pilot rod so that it can move within the extremes provided by the axial length of the slot and rod.

In operation of the second embodiment of the invention, formation fluid enters the lower extremity of the casing, where it is available at the pump inlet. Power fluid flows into the inlet end of the piston rod extension where it is always available within the radial passageways 96.

In FIGS. 5 and 6, on the upstroke, power fluid flows into the valve element annulus 97, through ports 131, into longitudinal passageway 99, and into the common piston chamber 82, where the power fluid forces the engine piston to move in an upward direction. At the same time, formation fluid is ingested into working chamber 92, while fluid is displaced from chamber 88. Fluid from chamber 88 flows through ports 120 and into the produced fluid annulus. The engine piston continues to upstroke within chamber 88 until pilot rod actuator 138 strikes the upper stop means, or shoulder 118, whereupon the pilot rod is shifted in a downward direction towards the lowermost end of slot 140.

This action moves the flat 137 relative to the valve element so that port 135 is connected to port 122; and accordingly, bore 124 is subjected to reduced pressure. The force of the power fluid above the valve element forces the element into its lowermost position with end portion 132 abutting the lower face 133 of counterbore 124.

Traveling annulus 130 now connects passageway 99 to port 121 so that chamber 82 is connected to the annulus 81 located between the piston and the engine cylinder wall, whereupon power fluid is now exerted against the end of rod 86, the well hydrostatic head is exerted within chamber 88, chamber 82 is subjected to the well hydrostatic head by means of the before mentioned flow passageway; and accordingly, the engine piston moves in a downward direction, thereby expelling spent power fluid from chamber 82 and formation fluid from the pump working chamber 92.

As the engine piston downstrokes to the lower limit of its travel, the pilot rod actuator 139 abuttingly engages the lower stop means, which comprises the circumferentially extending shoulder 119 presented by the upper free end of the pump barrel, thereby moving the pilot rod back into the illustrated position seen in FIGS. 5 and 6, whereupon the valve element is again shifted in an upward direction by the effect of power fluid being exerted in bore 124. The assembly now strokes in an upward direction because of the pressure differential across the engine piston, and the effective areas of the opposed sides of the engine piston.

It is considered that piston extension 86, piston enclosure portion 95, piston portion 90, and production pump piston 91 are connected together in any number of different manners to provide an effective unitary construction such as seen illustrated in FIGS. 5–9.

In the first embodiment of the invention, the end 41' of the rod forms a piston which is received within a cylindrical pocket 46' located adjacent to the lower actuator slot. In the second embodiment of the invention, the upper marginal end 116 of the rod forms a piston which is received within a cylindrical pocket 117, while the lower end 119' of the rod forms a piston which is received within a cylindrical pocket 118. Each rod piston and pocket cooperate together to form a dashpot which provides a suction to hold the plunger in an alternate position until the rod is forced to reciprocate into another of its alternate positions.

I claim:

1. In a downhole, fluid-actuated pump assembly having an engine and a production pump, with the production pump having a formation fluid inlet and a produced fluid outlet; and, with the engine having a power fluid inlet and a spent power fluid outlet; said engine having a cylindrical bore, an engine piston reciprocatingly received within said cylindrical bore and dividing said cylindrical bore into upper and lower engine chambers; said engine piston having an axial bore; a control rod, a valve element, said control rod being reciprocatingly and concentrically received within said engine piston and within said valve element; said valve element being reciprocatingly received within said axial bore of said engine piston such that said valve element can move between alternate positions; the improvement comprising:

spaced abutment means positioned at opposed ends of said cylindrical bore, means by which opposed ends of said control rod are arranged to contact said spaced abutment means to shift said control rod respective to said engine piston between an upper and a lower position as said engine piston reciprocates within said cylindrical bore;

means on said control rod and said valve element by which power fluid causes said valve element to shift from one to another of said alternate positions in response to said control rod being shifted from one to another of said upper and lower positions;

said production pump includes a production barrel, a production piston reciprocatingly received within said barrel, a hollow rod connecting said production piston to said engine piston, said production piston dividing said barrel into upper and lower production chambers; means connecting said upper production chamber directly to said production outlet;

means forming a flow passageway in said engine piston which extends from said lower engine chamber to said valve element, means directly connecting the power fluid inlet to said lower engine chamber; means forming a spent power fluid flow passageway from said valve element, through said hollow rod, and into said upper production chamber;

a passageway formed in said engine piston by which said upper engine chamber is connected to said valve element to provide for reciprocating said piston in a downward direction within said cylindrical bore; whereby:

said lower engine chamber is always connected to said power fluid source to thereby enable the engine piston to reciprocate the production piston in an upward direction when said upper engine chamber is connected to said lower engine chamber.

2. The pump of claim 1 wherein said production piston includes a traveling valve means mounted therein for controlling flow from said lower production chamber, through said production piston, and into said upper production chamber.

3. The pump assembly of claim 2 wherein said fluid-actuated pump assembly is of the free type and said formation fluid inlet is an axial passageway formed in a marginal, terminal end of the production pump, a standing valve means in the last said passageway which allows flow to occur only into said lower production chamber.

4. The pump assembly of claim 1 wherein said means by which opposed ends of said control rod are arranged to contact said spaced abutment means includes a lateral actuator affixed to the lower end of said control rod; a slot formed through a lower marginal end of said engine piston and said valve element, said lateral actuator extends through said slot into engagement with said abutment means and is moved longitudinally of said engine piston as said control rod is reciprocated respective to said piston and valve element.

5. The pump assembly of claim 4 wherein said spaced abutment means includes upper and lower abutment members, said lower abutment member is a shoulder which defines the lower end of said lower engine chamber while said upper abutment member is formed on the upper end wall of the upper cylinder chamber and abuts the upper terminal end of the control rod.

6. The pump assembly of claim 5 wherein said slot is radially misaligned with the spent power fluid passageway which interconnects the valve means with the upper production chamber.

7. In a fluid-operated pump assembly for operation downhole in a wellbore, wherein means are provided to convey power fluid from the surface of the ground downhole to the pump assembly, spent power fluid uphole to the surface of the ground, and formation fluid produced by the pump uphole to the surface of the ground; the pump assembly having a valve and engine section, and a pump section, all connected together to form said pump assembly; with the valve section controlling the flow of power fluid into and from the engine to thereby enable the engine to extract power from the power fluid, and with there being connecting rod means directly by which the engine section drives the pump section to enable the pump to perform the stated function of lifting fluid uphole; the improvement comprising:

said engine section includes an engine cylinder having an engine piston reciprocatingly received therein, said engine piston dividing said engine cylinder into an upper and a lower cylindrical engine chamber;

a control valve assembly which includes a control rod and a valve element; means forming an axial bore within said piston, said control rod being axially aligned and reciprocatingly received within said axial bore such that an annulus is formed therebetween; said valve element being reciprocatingly received within said annulus; a power fluid flow passageway means extending from the lower engine chamber to said valve assembly and from said valve assembly to said upper engine chamber;

means connected to said control rod and to the cylinder of said engine for moving said control rod to cause said control rod to reciprocate between two alternant positions in response to reciprocal movement of the engine piston respective to the engine cylinder to thereby cause said valve element to shift between an upper and a lower alternant position;

said pump section includes a production barrel having a production piston reciprocatingly received therein, said production piston dividing said barrel into upper and lower production chambers; said upper production chamber being directly connected to a produced fluid outlet; said lower production chamber having means forming an inlet and an outlet so that formation fluid can flow into the inlet and produced fluid can flow through the outlet;

means connecting said lower engine chamber directly to a power fluid inlet; said connecting rod being hollow; flow passageway means extending from said valve element, through said engine piston, through the interior of the connecting rod, and into the upper production chamber through which spent power fluid may be exhausted from the upper engine chamber on the upstroke;

whereby: said upper engine chamber is alternately connected to said power fluid source and said upper production chamber while said lower engine chamber is always connected to a power fluid source to thereby cause the engine piston to reciprocate the production piston.

8. The pump assembly of claim 7 wherein said production piston includes a traveling valve means therein for controlling flow from said lower production chamber, through said production piston, and into said upper production chamber.

9. In a fluid-operated pump assembly for operation downhole in a wellbore, including means to convey power fluid from the surface of the ground downhole to the pump assembly and spent power fluid and produced fluid uphole to the surface of the ground; said pump assembly having an engine section and a pump section, all connected together to form said pump assembly, said engine section includes a valve section for controlling the flow of power fluid into and from the engine section to thereby enable the engine section to extract power from the power fluid, and with there being connecting means by which the engine section drives the pump section to enable the pump section to perform the stated function of lifting fluid uphole; the improvement comprising:

said engine section includes a cylinder having an engine piston reciprocatingly received therein, said engine piston dividing said cylinder into an upper and a lower cylindrical engine chamber;

said pump section includes a pump barrel, a production piston reciprocatingly received within said pump barrel, rod means connected to said engine piston and pump piston so that said engine piston reciprocates said pump piston;

means forming an axial bore within said engine piston, a control rod axially aligned and reciprocatingly received within said axial bore such that an annulus is formed therebetween; a valve element reciprocatingly received within said annulus; power fluid flow passageway means extending from a power fluid source to said valve element and from said valve element to said upper engine chamber; spent power fluid flow passageway means extending from said valve element, through said connecting rod, and to said upper production chamber;

means by which said control rod reciprocates between two alternant positions in response to reciprocal movement of said engine piston respective to said engine cylinder, to thereby cause said valve element to shift between an upper and a lower alternant position;

so that said upper engine chamber is alternately connected to said power fluid source and said production fluid outlet; to thereby cause the engine piston to reciprocate the production piston.

10. The improvement of claim 9 wherein said means by which opposed ends of said control rod are arranged to contact said spaced abutment means includes a lateral actuator affixed to the lower end of said control rod; a slot formed through a lower marginal end of said engine piston and said valve element, said lateral actuator extends through said slot into engagement with said abutment means and is moved longitudinally of said engine piston as said control rod is reciprocated respective to said piston and valve element.

11. The improvement of claim 10 wherein said spaced abutment means includes upper and lower abutment members, said lower abutment member is a shoulder which defines the lower end of said lower engine chamber while said upper abutment member is formed on the upper end wall of the upper cylindrical chamber and abuts the upper terminal end of the control rod.

* * * * *